US005553959A

United States Patent [19]

Feldman et al.

[11] Patent Number: 5,553,959

[45] Date of Patent: Sep. 10, 1996

[54] NOTEBOOK SYSTEM

[76] Inventors: Jacobo Feldman; Shirley Czukerberg, both of 2101 NW. 53rd St., Boca Raton, Fla. 33496

[21] Appl. No.: 488,242

[22] Filed: Jun. 7, 1995

[51] Int. Cl.[6] ..... B42F 13/00

[52] U.S. Cl. ..... 402/79; 281/29; 281/37

[58] Field of Search ..... 402/70, 73, 80 R, 402/79, 31; 281/29, 37

[56] References Cited

U.S. PATENT DOCUMENTS

| | | | |
|---|---|---|---|
| 5,015,114 | 5/1991 | Miller | 402/80 R |
| 5,340,156 | 8/1994 | Bianco | 402/70 X |

FOREIGN PATENT DOCUMENTS

| | | | |
|---|---|---|---|
| 625130 | 9/1961 | Italy | 402/79 |
| 71937 | 2/1953 | Netherlands | 402/79 |

*Primary Examiner*—Willmon Fridie, Jr.
*Attorney, Agent, or Firm*—Frishauf, Holtz, Goodman, Langer & Chick

[57] ABSTRACT

A notebook system wherein a stack of sheets is bound together using a plurality of disk fastening members insertable into openings of the stack of sheets to retain the sheets in the stack. The disk members have a substantially flat disk-like central surface portion and an enlarged continuous rim portion which extends around the periphery of the central surface portion of the disks. The rim portion extends outwardly in a direction perpendicular to the flat central portions of the disks, and the central surface portion has a radius which is larger than the thickness of a stack of sheets to be bound thereby. Covers for the notebook comprise a front cover and a rear cover which are arranged to have a stack of sheets therebetween. The rear cover has a closure member integrally formed therewith, the closure member being a cut-out member which is partly cut-out from the rear cover member and which is bendable around the edge of the rear cover so as to extend over the front cover, and is attachable to an outer surface of the front cover to serve as a closure for a notebook.

14 Claims, 3 Drawing Sheets

NOTEBOOK SYSTEM

BACKGROUND OF THE INVENTION

This invention relates to notebook systems, and more particularly to notebook systems having removable pages and refill papers which can be added thereto by a user. The invention also relates to an improved cover for a notebook.

The term "notebook" is used herein for ease of description. However, the notebook binding system and notebook cover system disclosed herein are equally usable for other types of books booklets, or pamphlets or the like, such as pre-printed reports, pre-printed books, graph paper books, notebooks and/or printed books with dividers, and the like. The term "notebook" as used herein shall be deemed to cover any or all of such other forms where paper or other sheets are bound together and/or enclosed by a cover member, according to the present invention.

Various types of notebooks, including spiral type notebooks are known. Also, a notebook having disk-type binder or retainer members which are individually mounted in openings of the sheets of the notebook are known, for example from Italian Patent No. 625,130. In the prior art, however, turning of the pages of the notebook is impaired by binding of the pages on the disk-like binding or retaining members when the pages are turned.

The object of the present invention is to provide an improved notebook system having improved binding or retaining disk members which overcome the disadvantages of the prior art devices.

Another object of the present invention is to provide a notebook system having an improved cover with a closure clasp made integrally from one of the portions of the cover.

SUMMARY OF THE INVENTION

According to the present invention, a notebook system comprises a plurality of sheets in the form of a stack, each sheet having a plurality of openings therein which are spaced apart along an edge of the sheets, the respective openings of each sheet being aligned with each other; a plurality of disk-like fastening members insertable in said openings of said stack of sheets to retain said sheets in the stack; said disk members having a substantially flat disk-like central surface portion, an enlarged continuous rim portion which extends around the periphery of the central surface portion of said disks, the rim portion projecting outwardly in a direction substantially perpendicular to the substantially flat central surface portions; said central surface portion having a radius larger than the thickness of the stack of sheets to be bound thereby; and said projecting rim portion of each of said disks having a substantially semi-circular outer peripheral shape and having a substantially flat inner bearing surface which bears upon a substantially flat bearing surface of openings of said sheets which are bound by said disk members.

According to another aspect of the invention, a notebook system comprises a front cover; a rear cover; a plurality of sheets arranged in a stack between said front and rear covers; binding elements for binding together said front cover, said sheets and said bottom cover so that said covers and sheets are turnable relative to each other; and at least one of said front and rear covers having a closure member integrally formed therewith, said closure member comprising a cut-out member which is partly cut-out from said at least one of said front and rear covers; and said closure member being foldable around an edge of the notebook, extending between said front and rear covers, and over the other of said front and rear covers to securely close the notebook system.

The closure member has a plurality of thinned bend lines formed therein for facilitating bending thereof when it is wrapped or folded around the edge of said notebook. Also provided are fastening members for fastening an end portion of the closure member to the other of said front and rear covers to retain the closure member in its closed position.

DETAILED DESCRIPTION OF THE INVENTION

Figure 1:
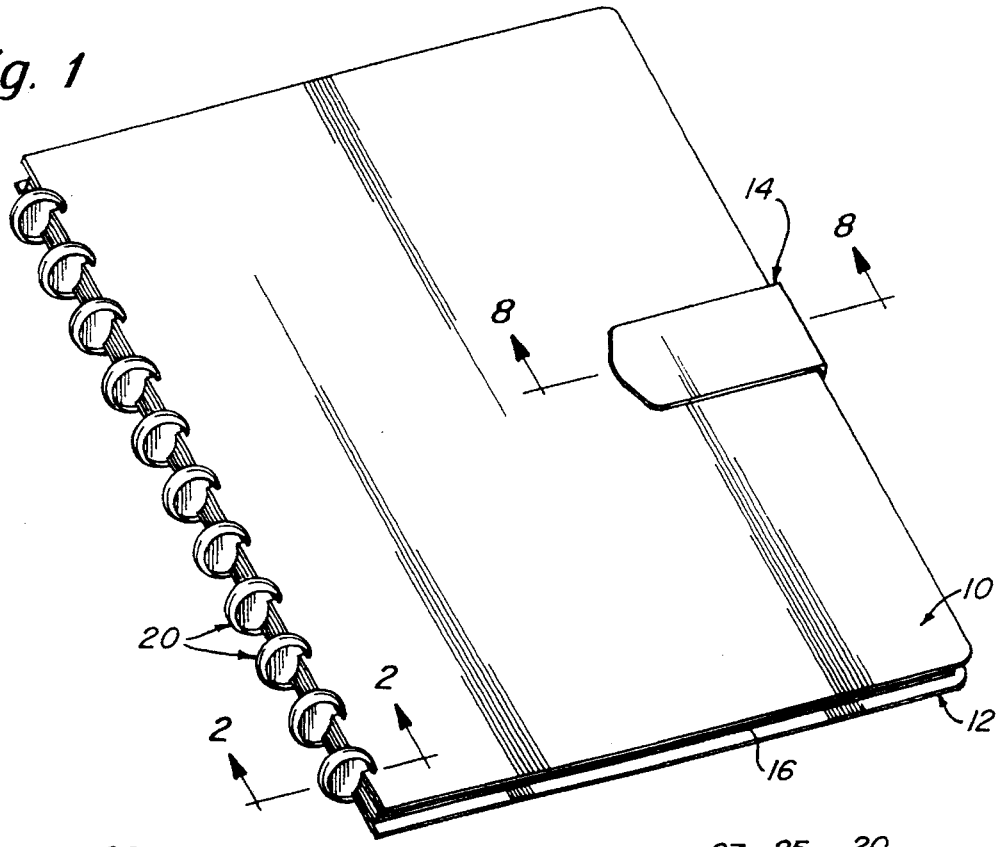
FIG. 1 is a perspective view of a notebook of the present invention in the closed condition.
Figure 2:
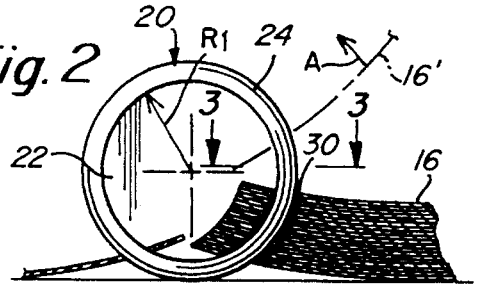
FIG. 2 is a partial sectional view taken along line 2—2 in FIG. 1, showing the disk-like binding members engaged with sheets of the notebook system.

Referring to FIG. 1, a notebook system according to the present invention comprises a top cover sheet member 10, a rear or bottom cover sheet member 12 and a closure member 14 which is integrally formed with the rear or bottom cover sheet member 12. The notebook system also comprises a plurality of sheets of paper or the like 16 arranged in a stack between the cover sheet member 10 and rear sheet member 12. The entire notebook system is retained together by means of a plurality of disk-like binding or fastening members 20 (hereinafter "disk-members") which are inserted into generally mushroom-shaped openings 30 (see FIG. 3) of the sheets 16 and of top and bottom cover members 10, 12. After assembly, the sheets can be turned or flipped individually or in groups relative to the notebook (as in a conventional notebook), as shown by the arrow A and the dashed line partly turned sheet 16' in FIG. 2.

Figure 3:
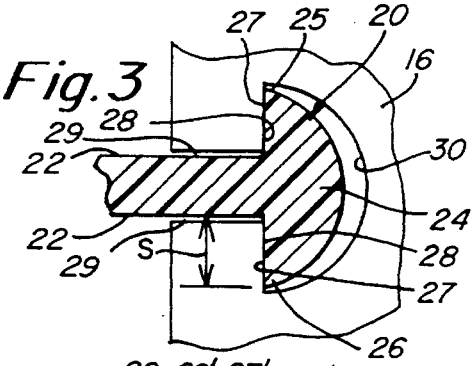
FIG. 3 is a sectional view taken along line 3—3 in FIG. 2, showing a binding member engaged in an opening of the sheets of the notebook.

The disk members 20 of the present invention have a central flat surface portion 22 which is smooth on both sides thereof and which has no raised projections or projecting surface portions thereon (see FIG. 3). The periphery of each disk member 20 comprises an enlarged continuous rim portion 24 extending around the entire periphery of the disk member, the rim portion 24 having an arcuate (or semi-circular) outer surface, sharp corners 25, 26 (in a width direction of the disk member) and a substantially flat inwardly facing bearing surface 27 which bears upon a substantially flat bearing surface 28 of the sheet members 16, 10, 12 used in the notebook system. The sheet members 16, 10, 12 also have substantially flat entry opening portions 29 which open to the "bound" edge of the sheet members, to permit insertion and engagement of the disk members 20, and which, when the notebook is assembled, oppose the flat central surface portions 22 of the disk members 20.

In the arrangement of the present invention, since the substantially flat central surfaces 22 of the disk members 20 are smooth and have no raised projections thereon, substantially no "binding" or "interference" occurs between disk surfaces 22 and surfaces 29 of the sheets when the sheets are turned. Thus, smoother turning is ensured. In the prior art device of FIG. 6, raised lettering and the like exists on the central side surfaces of the binding disks, as shown by reference numeral 40 in FIGS. 6 and 7. Thus, "binding" of the sheets occurs when the sheets turned, since the side walls 29 of the openings of the sheets interfere (contact) with the raised portions 40 of the disk members when the sheets are turned.

Figure 4:
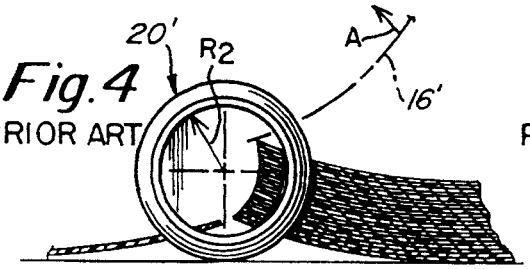
Fig. 4 PRIOR ART
FIG. 4 is a view similar to FIG. 2, but of a prior art device.
Figure 5:
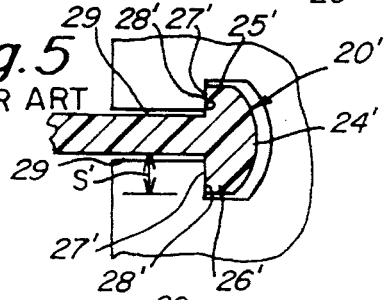
Fig. 5 PRIOR ART
FIG. 5 is a sectional view, similar to FIG. 3, but for the prior art device of FIG. 4.

In another prior art system shown in FIGS. 4 and 5, the end portions 25', 26' of the circular are rim portion 24' of the disk 20' are flattened (thereby shortening the width extent of the rim). Therefore, the bearing surfaces 27', 28' in the prior art device of FIGS. 4 and 5 extend for a length 5' (FIG. 5) which are smaller than the bearing surfaces S (FIG. 3) of the present invention. In a typical example, S=about 0.9 to about 0.95 inches (present invention) and S'=about 0.8 inches or less. In a specific example, S=about 0.93 inches.

Figure 6:
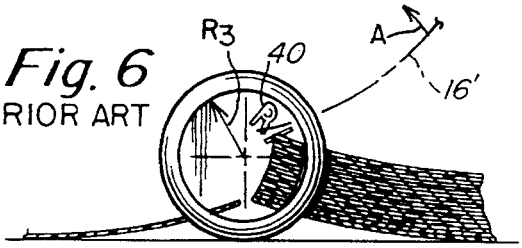
Fig. 6 PRIOR ART
FIG. 6 shows another view, similar to FIGS. 2 and 4, but of another prior art device.
Figure 7:
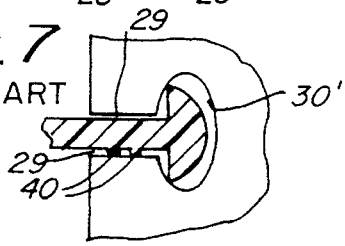
Fig. 7 PRIOR ART
FIG. 7 is a sectional view similar to FIGS. 3 and 5, but of the prior art device of FIG. 6.

In the prior art device shown in FIGS. 6 and 7, the sheets have curved openings 30' at the end of the entry channel formed by flat surfaces 29. The flat bearing surfaces 28 in the present invention do not exist. Therefore, as shown in FIG. 7 substantially "point contact" and "binding" occurs between the sheets and the disks (see FIG. 7) when the sheets turn, and the sheets cannot turn as smoothly as in the present invention.

Figure 12:
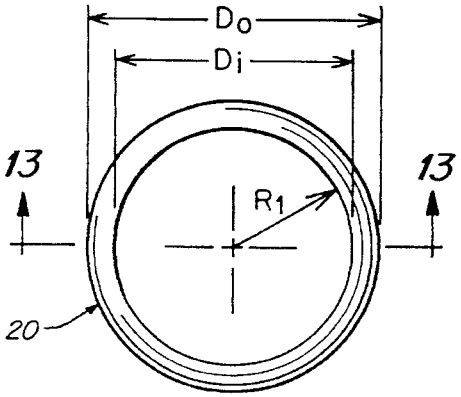
FIGS. 12 and 13 are side and sectional views, respectively, of a disk member of the present invention.
Figure 13:
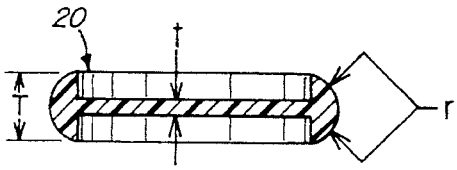

As shown in FIGS. 12 and 13, the disk member 20 of the present invention is preferably made of high impact styrene, and has a radius R1 of about ⅜ inches ($D_1$=0.75 inches). In the prior art embodiment of FIGS. 4 and 6, the radius R2 and R3 are estimated to be about 0.3 inches, substantially less than the radius R1 of the disk member 20 of the present invention. In the disk member of the present invention, the overall outer diameter $D_o$ of the disk is about 0.9 inches. FIG. 13 shows that T is about 0.22 inches, t is about 0.4 inches, and the radius r of the outer surface of the rim 24 is about 0.1 inches.

Another feature of the notebook of the present invention is the integral closure member 14 which is integrally formed with one of the top cover sheet and the bottom cover sheet 10, 12 of the notebook system. In the illustrated embodiment, the closure member 14 is formed integrally with the bottom cover sheet 12. However, the positions could be reversed and the closure member could be formed integrally with the top cover sheet 10 in exactly the same manner (not shown).

Figure 8:
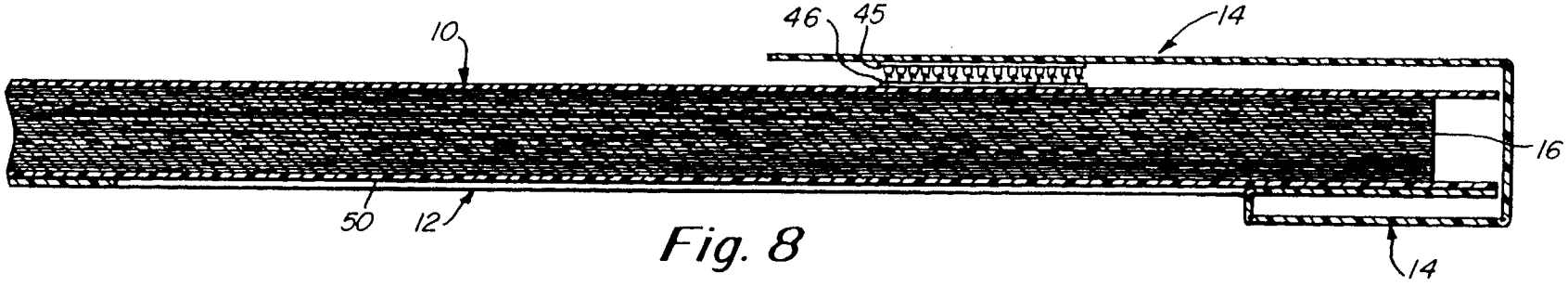
FIG. 8 is a partial sectional view of the notebook system taken along line 8—8 in FIG. 1.
Figure 9:
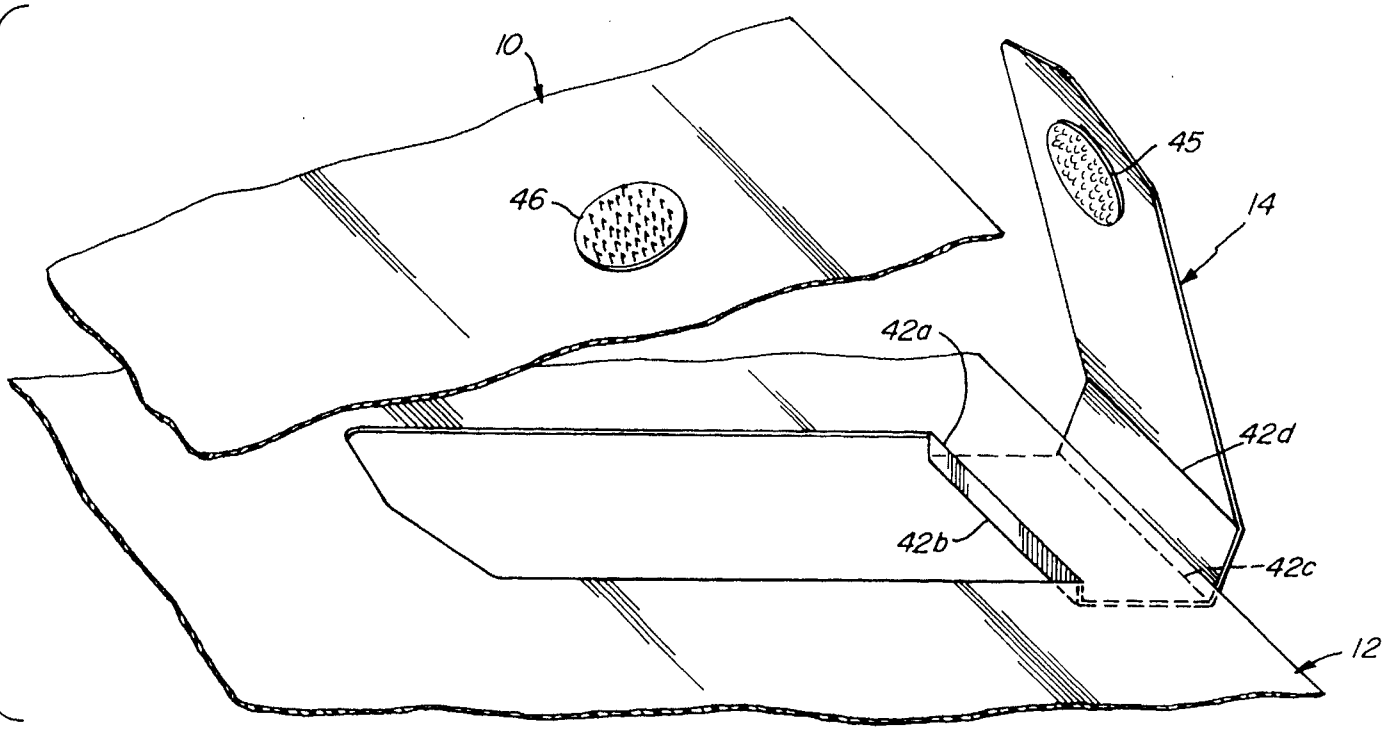
FIG. 9 is an exploded, partial perspective view showing the members of FIGS. 1 and 8 in greater detail.
Figure 10:
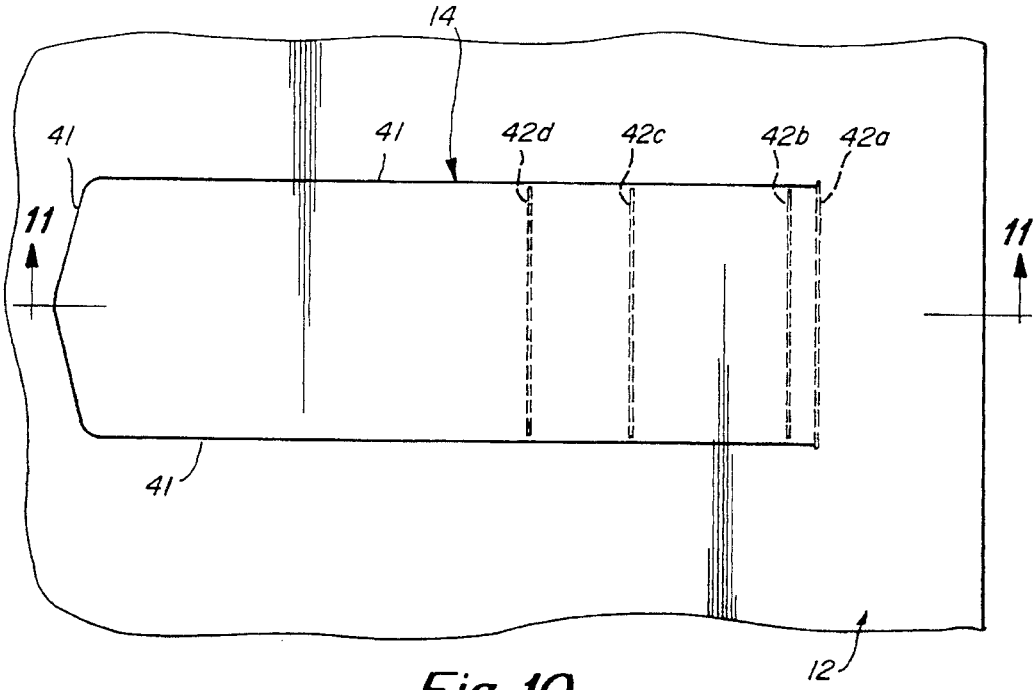
FIG. 10 shows the rear cover of the notebook system of FIG. 1, after stamping, but before turning or folding the integral closure member out from the rear cover member of the notebook.
Figure 11:
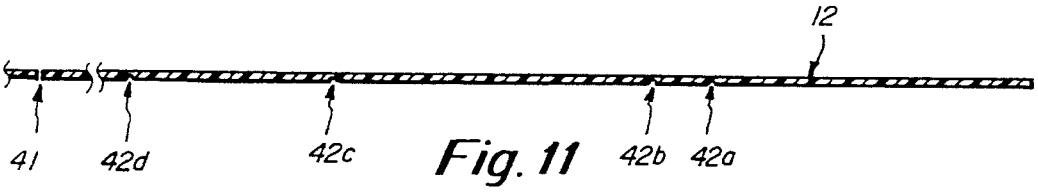
FIG. 11 is a sectional view taken along line 11—11 showing the cuts and bend areas formed in the rear cover member of the notebook to form the integral closure member.

Referring to FIGS. 8–11, the bottom cover sheet 12 is made of a plastic sheet material (e.g., polypropylene) which is stamped out, and which is stamped with a generally U-shaped out line 41, and with plurality of thin bend lines **42*a*, 42*b*, 42*c*, 42*d*, as best seen in FIGS. 10 and 11. The cut lines 41 and bend lines 42 are preferably formed in a single stamping operation with the forming of sheets 12, as should be readily apparent to those skilled in the art. After the bottom cover sheet 12 is stamped out, and the notebook has been assembled, the closure member 14 is folded downwardly about fold line 42*a* and out from the major surface of bottom cover sheet 12, to the position shown, for example, in FIG. 9. The closure member 14 can then be folded about the bend lines 42*b*–42*d* and wrapped around the free end edge of the closed notebook (the edge opposite to the disk members 20), as shown in FIGS. 1 and 8. A hook and loop type of fastener (Velcro) can be used to retain the closure member 14 in its closed position as shown in FIGS. 1 and 8. The loop fastener 45 is adhered to the end of closure member 14 for example by means of adhesive, and the hook fastener 46 is adhered to a mating surface portion of the top cover 10, for example by means of an adhesive. When the closure member 14 is wrapped or folded completely around the edge notebook to the position shown in FIGS. 1 and 8, the hook and loop fastening members 45, 46 engage each other to retain the notebook in a closed position. Other fastening members, such as snap or other suitable fastening member could be used. The closure member 14 can be arranged to fold around the top and/or bottom edges of cover sheets 10, 12, either with or without a closure member folding around the long side edge (FIG. 1**).

The fold lines **42*a*–42*d* are provided so that the closure flap 14 is easily formed to the desired shape. However, if the material from which the rear cover 12 is made is sufficiently bendable, the fold lines 42*a*–42*d* can be eliminated, and the closure flap member 14 could be bent around the free end edges of the cover sheets, without sharp bends. However, at least one bend line 42*a* is preferred to enable the closure flap 14 to fixed end neatly from the rear cover sheet 12**.

The top and bottom cover sheets 10, 12 are preferably made from polypropylene and are stamped by, for example, die cutting. The top and bottom cover sheets, in a particular embodiment using polypropylene, are around 0.04" thick, in order to provide substantial rigidity and protection for the stack of sheets included in the notebook.

The notebook system also includes an optional plastic (polypropylene) liner sheet 50 shown in FIG. 8 which backs the rear of the stack of sheets 16 in the notebook. The optional liner sheet covers the opening formed by the turning or folding out of the closure member 14, protects the sheets in the notebook, and also renders the resulting notebook system more sturdy.

While the invention has been described with respect to sheets inserted in the notebook, it should be clear that other inserts, such as dividers, sheet protectors, pencil cases with a mounting edge which engages the disk members, etc., could be used in the notebook.

An advantage of the notebook having the covers 10, 12 and closure member 14 described hereinabove is that the covers can be formed of sheet plastic by a simple stamping process, and the result is a very attractive, very sturdy, very easy to use and very serviceable structure which is also relatively low cost and relatively easy to manufacture.

While the invention has been described with respect to specific structural features, it should be clear that various modifications and alterations could be made within the scope of the appended claims.

What is claimed is:

1. A notebook system comprising:

a plurality of sheets arranged in a stack, each sheet having a plurality of openings therein which are spaced apart along an edge of the sheets, the respective openings of each sheet in the stack being aligned with each other, each opening having a generally mushroom-shape configuration with a bulbous opening portion and a stem opening portion which connects said bulbous opening portion to an open edge of said sheet, said bulbous opening portion defined by an arcuate surface having opposite ends and a substantially flat bearing surface having opposite ends which are substantially coincident with the opposite ends of said arcuate surface, and said small opening portion being defined by a narrow channel opening having a width smaller than a with of said flat bearing surface and connecting the open edge of said sheet to said flat bearing surface;

a plurality of disk-like fastening members insertable in respective openings of said stack of sheets to retain said sheets in said stack;

said disk members each having a substantially flat disk-like central surface portion having a central axis, and an enlarged continuous rim portion which extends around the periphery of the central surface portion of said central surface portion, said rim portion projecting outwardly in a direction substantially perpendicular to the central axis of said substantially flat central surface portion;

said central surface portion of each disk member having a radius (R1) which is larger than a thickness of said stack of sheets to be bound thereby, and said central surface portion extending within said stem opening portion; and said projecting rim portion of each of said disks including an arcuate outer peripheral surface having opposite ends and a substantially flat inner facing bearing surface having opposite ends which are substantially coincident with the opposite ends of said arcuate outer peripheral surface, with said projecting rim portion extending within said bulbous opening portion such that said substantially flat inner facing bearing surface bears upon said substantially flat bearing surface of said bulbous opening portion of said openings of said sheets of said stack which are bound by said disks members.

2. The notebook system of claim 1, wherein said central surface portion of said disk members are substantially flat and have no projections or raised portions thereon.

3. The notebook system of claim 1, wherein said projecting rim of each of said disks has a substantially semi-circular outer peripheral shape which extends to a point area where said semi-circular outer peripheral shape meets said substantially inner facing bearing surface.

4. The notebook system of claim 1, wherein said stack of sheets has a thickness which is substantially less than the radius (R1) of said central surface portion of said disk members.

5. A notebook system comprising:

a front cover having a binding edge and an opposite free edge;

a rear cover having a binding edge and an opposite free edge;

a plurality of sheets arranged between said front and rear covers;

binding elements for binding together said front cover at said binding edge thereof, said sheets and said bottom cover at said binding edge thereof so that said covers and sheets are turnable relative to each other;

at least one of said front and rear covers having a closure member integrally formed therefrom, said closure member comprising a cut-out member which is partly cut-out from said at least one of said front and rear covers at a cut-out portion thereof, and being bendable around an edge of the notebook and over the other of said front and rear covers, said cut-out member being bendably secured to said at least one of said front and rear covers at an edge of said cut-out portion which is spaced from the opposite free edge of said at least one of said front and rear covers.

6. The notebook of claim 5, wherein said closure member has a plurality of bend lines formed therein for facilitating bending thereof when it is bent around said edge of said notebook.

7. The notebook of claim 6, wherein said closure member comprises four bend lines formed therein, one of said bend lines being at a position where said closure member integrally extends from said edge of said cut-out portion of said at least one of said front and rear covers.

8. The notebook of claim 5, further comprising fastening members arranged to fasten an end portion of said closure member to said other of said front and rear covers to retain said closure member in said closed position.

9. The notebook of claim 8, wherein said fastening members comprises hook and loop fastening members.

10. A set of front and rear covers for a notebook system, comprising:

a front cover member having a binding edge and an opposite free edge;

a rear cover member having a binding edge and an opposite free edge;

a closure member integrally formed with at least one of said front and rear cover members, said closure member comprising a cut-out member which is partly cut-out from said at least one of said front and rear cover members at a cut-out portion thereof, and being bendable around at least one bend line so as to extend past and around edges of the front and rear cover members and over the other of said front and rear cover members, said cut-out member being bendably secured to said at least one of said front and rear covers at an edge of said cut-out portion which is spaced from the opposite free edge of said at least one of said front and rear covers.

11. A set of front and rear covers for a notebook system according to claim 10, wherein said closure member has a plurality of bend lines formed therein for defining bend points thereof when it is bent around said edges of said cover members.

12. A set of front and rear covers for a notebook system according to claim 11, wherein said closure member comprises four bend lines formed therein, one of said bend lines being at a position where said closure member integrally extends from said edge of said cut-out portion of said at least one of said front and rear covers.

13. A set of front and rear covers for a notebook system according to claim 10, further comprising fastening members arranged to fasten an end portion of said closure member to said other of said front and rear covers to retain said closure member in said closed position.

14. A set of front and rear covers for a notebook system according to claim 13, wherein said fastening members comprises hook and loop fastening members.

* * * * *